US009366128B2

(12) United States Patent
Brouwer et al.

(10) Patent No.: US 9,366,128 B2
(45) Date of Patent: Jun. 14, 2016

(54) AUTOMATED WELLBORE EQUIPMENT FEEDING SYSTEM

(71) Applicants: Dominik Brouwer, Hannover (DE); Joerg Lehr, Celle (DE)

(72) Inventors: Dominik Brouwer, Hannover (DE); Joerg Lehr, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 361 days.

(21) Appl. No.: 13/900,062

(22) Filed: May 22, 2013

(65) Prior Publication Data

US 2014/0345858 A1 Nov. 27, 2014

(51) Int. Cl.

| | |
|---|---|
| ***E21B 19/02*** | (2006.01) |
| ***E21B 44/00*** | (2006.01) |
| ***E21B 23/00*** | (2006.01) |
| ***E21B 19/08*** | (2006.01) |

(52) U.S. Cl.

CPC ..... *E21B 44/00* (2013.01); *E21B 19/02* (2013.01); *E21B 19/08* (2013.01); *E21B 23/00* (2013.01)

(58) Field of Classification Search

CPC ..... E21B 19/00; E21B 19/002; E21B 19/16; E21B 19/165; E21B 19/18

See application file for complete search history.

(56) References Cited

U.S. PATENT DOCUMENTS

| | | | | |
|---|---|---|---|---|
| 3,591,022 A | | 7/1971 | Polyakov et al. | |
| 3,685,669 A | | 8/1972 | Morrison | |
| 3,743,107 A | | 7/1973 | Verschoof | |
| 3,842,986 A | | 10/1974 | Hupkes | |
| 3,865,256 A | | 2/1975 | Freeman, Sr. | |
| 4,040,524 A | | 8/1977 | Lamb et al. | |
| 4,212,576 A | | 7/1980 | George | |
| 4,545,017 A | * | 10/1985 | Richardson | G01P 3/68 254/276 |
| 4,625,938 A | | 12/1986 | Brown | |
| 4,883,184 A | | 11/1989 | Albus | |

(Continued)

OTHER PUBLICATIONS

Shiang 1999 Dynamic Analysis of the Cable Array Robotic Crane—Proceedings of the IEEE Conference on Robotics and Automation Shiang, Cannon and Gorman Dec. 31, 1999; Abstract: A new type of crane which uses four actuated cables to control the motion of the payload is presented. p. 2496: In order to find proper tensions, optimal force distribution,[3], is used with adequate constraints for the cable tensions and a suitable objective function. The equations are then formulated in the standard linear programming (LP) form.

(Continued)

*Primary Examiner* — William P Neuder

(74) *Attorney, Agent, or Firm* — Mossman Kumar & Tyler PC

(57) ABSTRACT

An apparatus for manipulating objects include a plurality of actuators distributed on a rig. The actuators cooperate to orient and move the well equipment. Each actuator may include at least one non-rigid tension member configured to engage the well equipment, and at least one sensor generating a signal representative of at least one parameter of: (i) a length of at least one of the at least one non-rigid tension members, (ii) a tension along at least one of the at least one non-rigid tension members, (iii) a position of at least one of the at least one non-rigid tension members; and (iv) an orientation of at least one of the at least one non-rigid tension members. The actuators may also each include a drum guiding each of the at least one non-rigid tension members and a motor rotating each drum. The apparatus further includes a controller in communication with the actuators, the controller being programmed to move the object based on the at least one sensor signals.

18 Claims, 5 Drawing Sheets

(56) References Cited

U.S. PATENT DOCUMENTS

| | | | | |
|---|---|---|---|---|
| 4,932,541 | A | 6/1990 | Belsterling | |
| 5,408,407 | A | 4/1995 | Lefkowitz et al. | |
| 5,440,476 | A | 8/1995 | Lefkowitz et al. | |
| 5,585,707 | A | 12/1996 | Thompson et al. | |
| 6,513,605 | B1 | 2/2003 | Loedden | |
| 6,566,834 | B1 | 5/2003 | Albus et al. | |
| 6,644,486 | B2 | 11/2003 | Jacoff et al. | |
| 6,826,452 | B1 | 11/2004 | Holland et al. | |
| 7,239,106 | B2 | 7/2007 | Rodnunsky et al. | |
| 8,192,127 | B2 | 6/2012 | Angman | |
| 2007/0205405 | A1 * | 9/2007 | Stockmaster et al. | ..... 254/275 |
| 2008/0136203 | A1 | 6/2008 | Krijnen et al. | |
| 2008/0210652 | A1 | 9/2008 | Tavio Diaz et al. | |
| 2011/0272377 | A1 | 11/2011 | Willim et al. | |
| 2013/0001181 | A1 | 1/2013 | Wegener | |

OTHER PUBLICATIONS

Shiang 2000 Optimal Force Distribution Applied to a Robotic Crane with Flexible Cables Proceedings of the IEEE Conference on Robotics and Automation Shiang, Cannon and Gorman Dec. 31, 2000 Abstract: A multiple cable robotic crane designed to provide improved cargo handling is investigated. p. 1948: The four-cable array robot shown in Fig. 1 is proposed to manipulate a container load in an efficient way in factories, construction sites and shipyards by controlling the length of all four flexible cables simultaneously.

Gorman 2001 The Cable Array Robot: Theory and Experiment Proceedings of the IEEE International Conference on Robotics and Automation Gorman, Jablakow and Cannon Dec. 31, 2001 p. 2804: In this paper, one specific type of cable array robot which has three cables is examined in detail. p. 2805: Redundancy can also be used to guarantee that the system is fully constrained throughout the workspace. This approach was used by Maeda et al. [7] and Tadokoro et al. 1111 for a six degree-of-freedom fully constrained robot with eight cables.

Stewart 1965 A Platform with Six Degrees of Freedom The Institution of Mechanical Engineers, vol. 180, Part I, No. 15, pp. 371-386, Proceeding 1965-1966. Stewart Dec. 31, 1965 Abstract: This paper describes a mechanism which has six degrees of freedom, controlled in any combination by six motors p. 372: The six-degrees-of-motion platform is, as the name implies, capable of moving in three linear directions and three angular directions singly or in any combination.

Chen 2011 Multi-rope hoist wire rope tension on-line monitoring and analysis of reasons about tension imbalance Consumer Electronics, Communications and Networks (CECNet), 2011 International Conference, Apr. 16-18, 2011 Chen Dec. 31, 2011 Abstract: This paper introduces a multi-rope hoist wire rope tension on-line monitoring system, which is used to monitor the tension of multi-rope hoist wire rope in real time, thus to calculate the real hoisting load and tension difference.

Zhang 2009 Kinematic analysis of a 6-DOF wire-based tracking device and control strategy for its application in robot easy programming Robotics and Biomimetics (ROBIO), 2009 IEEE International Conference, Dec. 19-23, 2009 Zhang Dec. 31, 2009 Abstract: This paper deals with the problem of a novel active, online, lead-through robot programming method based on a 6-DOF wire-based tracking device . . . Three different control strategies are analyzed for its application in robot easy programming. The time delay in the information transmission is also discussed.

PCT/US2014/039076—International Search Report dated Sep. 15, 2014.

* cited by examiner

AUTOMATED WELLBORE EQUIPMENT FEEDING SYSTEM

CROSS-REFERENCE TO RELATED APPLICATIONS

None.

BACKGROUND OF THE DISCLOSURE

1. Field of the Disclosure

This disclosure relates generally to oilfield, geothermal and mining systems for improvement of efficiency of handling equipment.

2. Background of the Art

Well construction facilities use several methods for transferring well equipment between two or more locations on the rig site. Illustrative well equipment includes, but is not limited to, pipe, drill pipe, drill collars, casing, liner, screens, drilling motors, MWD subs, bottom hole assemblies (BHA), and other devices and components used to construct, complete, and service a well.

Conventionally, rigs use cranes and hoisting systems for moving well equipment. A common system is a pipe mover, which moves a pipe between a horizontal orientation and a vertical orientation. Typically, these devices include interconnected arms that are associated with a boom and hydraulic actuators connected to each of the components. These hydraulic actuators usually require a significant amount of energy during operation. Much of this energy is used to move the components of pipe mover and not the pipe itself. These types of systems may be considered to use serial kinematics. That is, movement and energy is transmitted in a serial fashion from one arm to another to well equipment. A pipe mover is typical of well equipment handling devices that expend a considerable amount of energy to move itself while moving well equipment.

In aspects, the present disclosure provides more energy-efficient methods and systems for moving well equipment.

SUMMARY OF THE DISCLOSURE

In aspects, the present disclosure provides an apparatus for manipulating an object. The apparatus may include a first actuator having a least one non-rigid tension member configured to engage the object at a first contact point; a second actuator having at least one non-rigid tension member configured to engage the object at a second contact point; and a controller in communication with the first actuator and the second actuator. The first actuator and the second actuator cooperate to orient and move the object. The controller estimates a length of the at least one non-rigid tension member of the first actuator and the second actuator.

In aspects, the present disclosure provides a method for manipulating an object. The method may include distributing a plurality of actuators on a rig and orienting and moving the well equipment by operating the actuators using a controller in communication with the actuators. Each actuator may include at least one non-rigid tension member configured to engage the well equipment, and at least one sensor generating a signal representative of at least one parameter. The parameter may be one or more of (i) a length of at least one of the at least one non-rigid tension members, (ii) a tension along at least one of the at least one non-rigid tension members, (iii) a position of at least one of the at least one non-rigid tension members; and (iv) an orientation of at least one of the at least one non-rigid tension members. The controller may be programmed to move the object based on the at least one sensor signals.

In aspects, the present disclosure provides an apparatus for manipulating well equipment. The apparatus may include a rig; a plurality of actuators distributed on the rig, the actuators cooperating to orient and move the well equipment, wherein each actuator includes: at least one non-rigid tension member configured to engage the well equipment, and at least one sensor generating a signal representative of at least one parameter selected from a group consisting of: (i) a length of at least one of the at least one non-rigid tension members, (ii) a tension along at least one of the at least one non-rigid tension members, (iii) a position of at least one of the at least one non-rigid tension members; and (iv) an orientation of at least one of the at least one non-rigid tension members; a drum guiding each of the at least one non-rigid tension members; and a motor rotating each drum; and a controller in communication with the actuators, wherein the controller is programmed to move the object based on the at least one sensor signals.

Examples of certain features of the disclosure have been summarized in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

Figure 1A:
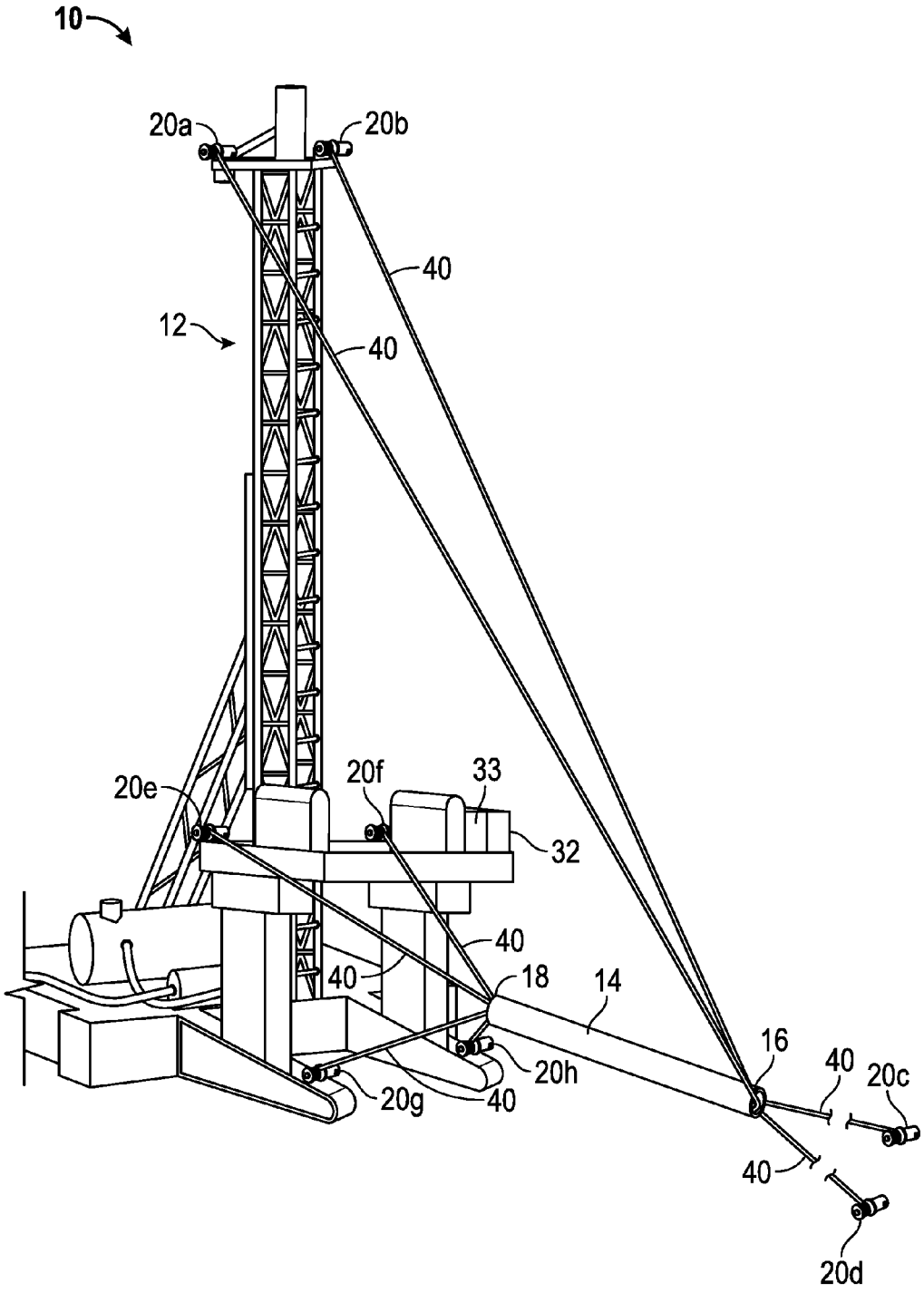
FIGS. 1A-C schematically illustrate an exemplary well equipment handling system that uses parallel kinematics in accordance with one embodiment of the present disclosure.

Referring initially to FIG. 1A, there is shown an equipment handling system 10 in accordance with one embodiment of the present disclosure. The system 10 may be used on land as well as offshore rigs 12 to move and orient well equipment. By "orient," it is meant to spin, rotate, tilt, or otherwise displace equipment relative to an internal reference frame. By "move," it is meant to displace equipment from one location to another; i.e., displace relative to an external reference frame. As used herein, a "handling" system is a system that can both orient and move an object. Illustrative well equipment that can be handled by the system 10 includes, but is not limited to, tubulars, pipe, drill pipe, packers, bridge plugs, drill collars, casing, liner, screens, drilling motors, MWD subs, bottom hole assemblies (BHA), completion tools, workover tools, electric submersible pumps (ESPs), and other devices and components used to construct, complete, and service a well.

The system 10 may include a plurality of actuators 20*a-h*, a plurality of wires 40, and a controller 60. The system 10 may include enough actuators 20*a-h* to provide six degrees of freedom for handling an object, such as equipment 14. The six degrees of freedom include rotation about three axes and linear movement along three axes. Additionally, the system 10 may be also arranged to utilize parallel kinematics. That is, all of the actuators 20*a-h* are directly connected to the equipment 14. Thus, minimal energy is used by each of the actuators 20*a-h* to move objects other than the equipment 14. As discussed in greater detail below, the controller 60 may be programmed to control the length and/or tension of the wires 40 by transmitting appropriate control signals to the actuators 20*a-h*. By manipulating the wires 40 in this manner, equipment 14 connected to the wires may be precisely moved and oriented.

Figure 2:
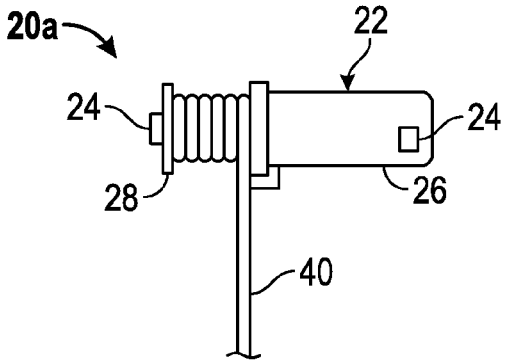
FIG. 2 schematically illustrates an actuator that may be used with the FIGS. 1A-C system.

Referring to FIG. 2, there is shown in greater detail the features of one of the actuators 20*a*. The actuator 20*a* may include a rotary power device 22 and one or more sensors 24. The rotary power device 22 may be controlled using control signals transmitted by the controller 32 (FIG. 1A). The rotary power device 22 may include an electric motor 26 (e.g., servomotor) that generates rotary power for rotating a drum 28 on which the wire 40 rides. The wire 40 may be spooled on the drum 28. Alternatively, the wire 40 may be stored elsewhere. The sensors 24 may be configured to provide information that can be used to determine the orientation and/or location of the equipment 14 (FIG. 1A). A variety of parameters may be estimated to make such determinations. For example, a sensor 24 may be an RPM counter that is incorporated into the motor 26 to count rotations. In some embodiments, a rotary plate counter may be used to count rotations and thereby estimate the length of the wires 40. The diameter of the drum 28 may change during rotation due to the layers of wire 40 increasing or decreasing. A separate sensor or correction factor may be used to estimate and account for this diameter change. The sensor 24 may also be incorporated into the motor 26 to estimate current or voltage drops. The sensor 24 may also be a sensor that estimates the tension in the wire 40 and/or the length of the wire 40.

In certain embodiments, GPS devices and other similar positioning/location sensors. Additionally, video signals may be used to estimate the position and orientation of the equipment 14 or other components of the system 10. For instance, a 2D or 3D video monitor may be used to acquire visual information regarding the equipment 14. This information may be used to estimate the position of the equipment 14. Of course, two or more different sensor types (e.g., visual, acoustic, radar, etc., tension, rotation, LVDT, etc.) may be used cooperatively to estimate movement, orientation, and position of the equipment 14. For example, a first set of sensors (e.g., GPS or visual) may be used to obtain a general or "rough" estimate of a position or orientation of the equipment 14. A second set of sensors (e.g., rotation counter) may be used for "fine" or precise positioning and orientation.

A suitable bi-directional transmitter 33 may be used to transmit the sensor information to the controller 32 and to transmit control signals from the controller 32 to the rotary power device 22. The bi-directional transmitter 33 may use solid data carriers (e.g., metal fibers or optical fibers) or wireless technologies (e.g., RF signals).

In one embodiment, two sets of actuators 20*a-d,e-h* may be used to move and orient the equipment. Each set of actuators 20*a-d, e-h* attaches to an opposing end of the equipment 14. For example, an upper set of actuators 20*a-d* attaches to an upper attachment point 16 of the equipment 14 and a lower set of actuators 20*e-h* attaches to a lower attachment point 18 of the equipment 14. The upper actuator set includes actuators 20*a-d*. The lower actuator set includes actuators 20*e-h*. While the attachment points 16, 18 are shown at the ends of the equipment 14, the attachment points 16, 18 may be anywhere along the axial length of the equipment. Likewise, while four actuators are shown in each actuator set, greater or fewer numbers of actuators may be used.

As should be appreciated, each of the actuators 20*a-d* and actuators 20*e-h* apply a force vector (e.g., tension at a specific direction) to the equipment 14. It should also be appreciated that the length of wire 40 between each of the actuators 20*a-d* and actuators 20*e-h* and their respective attachment points 16, 18 determines the location and orientation of the equipment 14.

The controller 32 may be used to orient and move the equipment 14. In one arrangement, the controller 32 may be programmed to autonomously control the handling operation. That is, the controller 32 may be programmed to control the actuators 20*a-h* to orient the equipment 14 relative to an internal reference frame and move the equipment 14 relative to an external reference frame. For instance, the controller 32 may include an information processing device (not shown) that may be programmed with algorithms, programs, mathematical models, or instructions to estimate an orientation and/or position relating to the equipment 14 based on the information acquired from the sensors 24. The controller 32 may also be programmed with a predetermined path or trajectory for the equipment. Based on this pre-programming and acquire information, the controller 32 may operate in an autonomous mode to move/orient the equipment 14. The controller 32 may also be responsive to human inputs and thereby operate in a manual or semi-autonomous mode. The controller 32 may use the bi-directional transmitter 33 for communicating with the actuators 20*a-h*. The bi-directional transmitter 33 may use wired or wireless communication equipment.

Figure 1B:
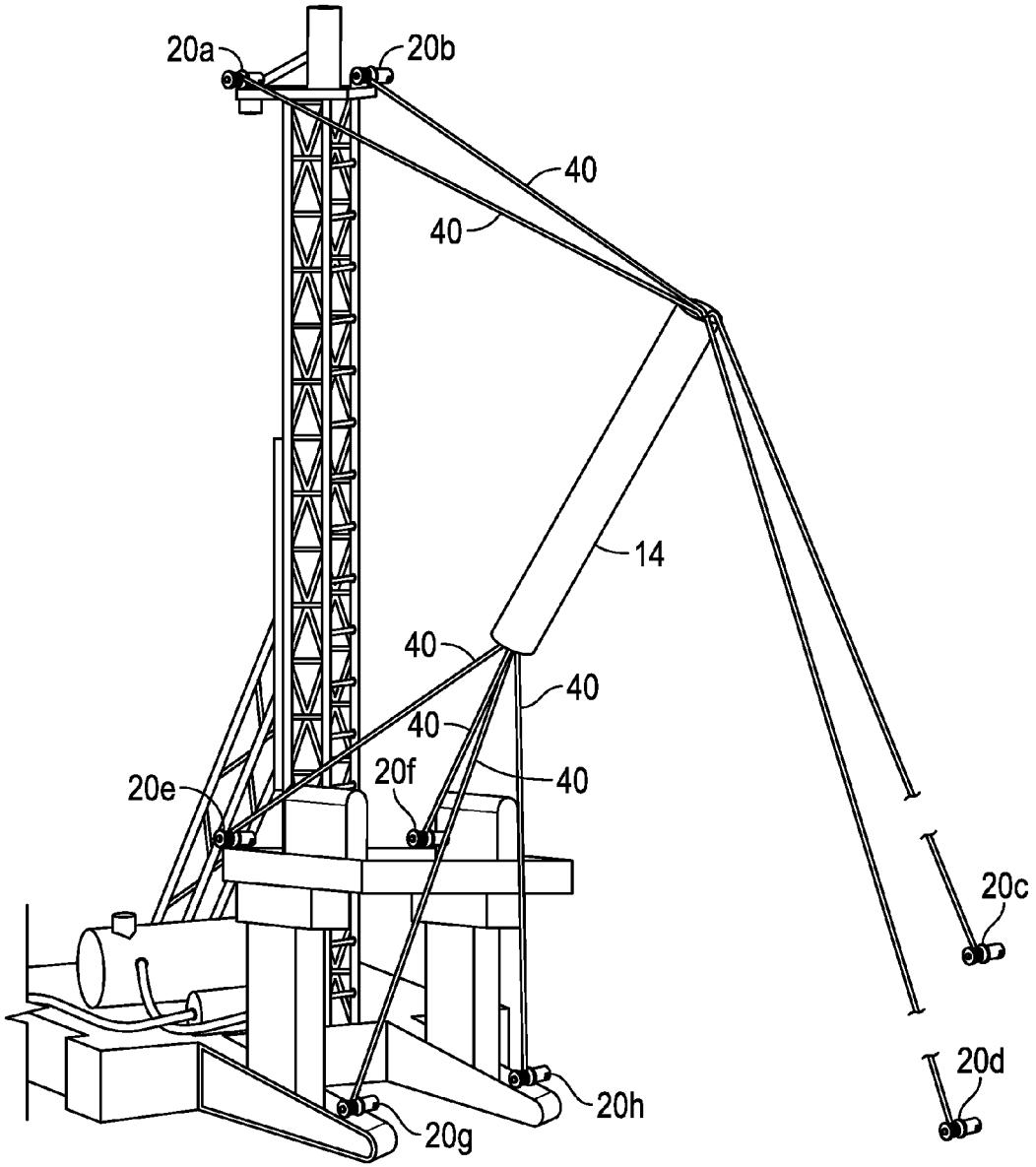
Figure 1C:
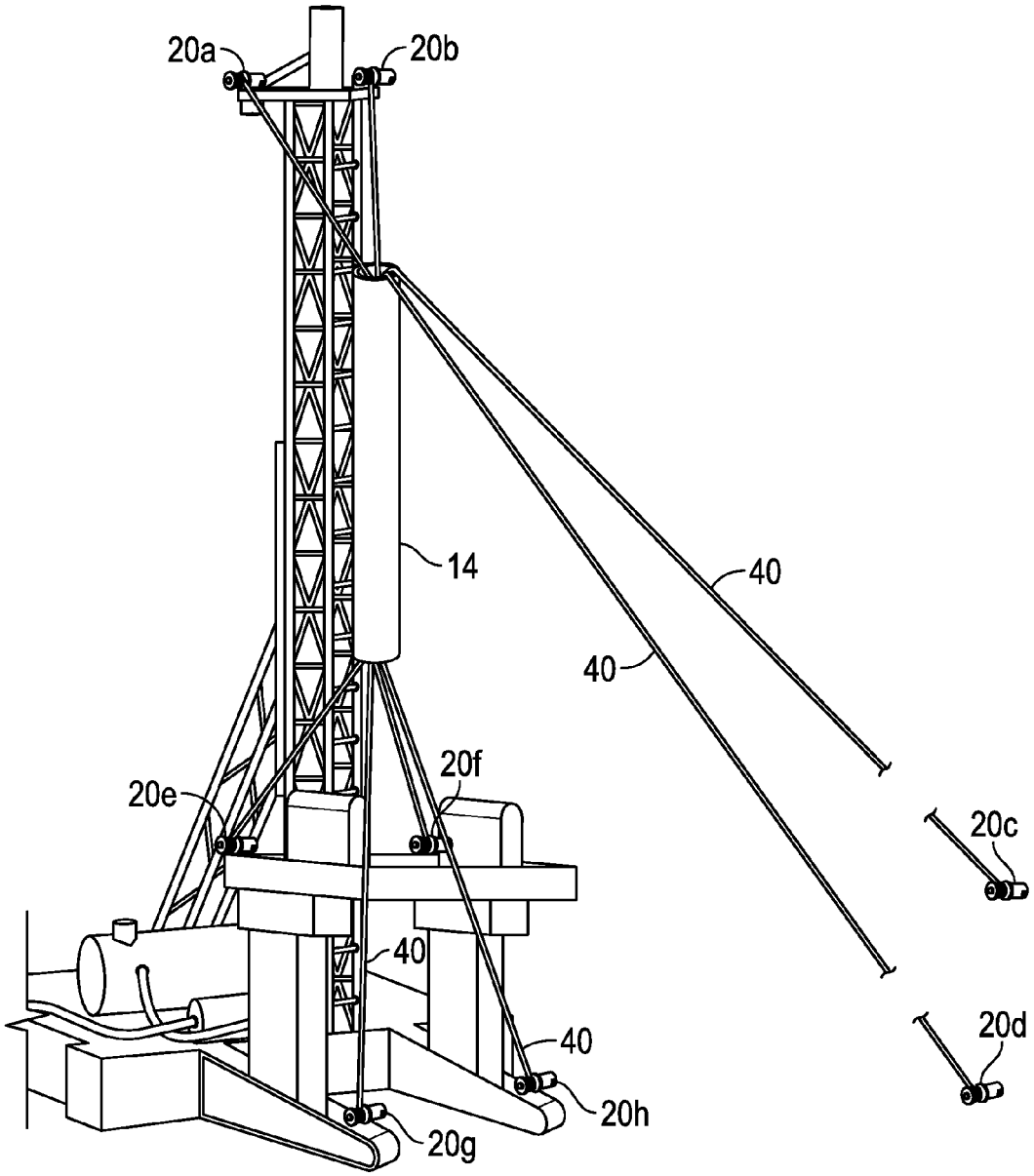

Referring to FIGS. 1A-C, an exemplary use of the system 10 will be described. In FIG. 1A, the equipment 14 is shown in a start position. In FIG. 1B, the equipment 14 is shown in an intermediate position. In FIG. 1C, the equipment 14 is shown in a stop or final position. The equipment 14 may be moved by changing the length and/or tension of the wires 40 using the actuators 20*a-h*. Specifically, the actuators 20*a-h* can change the length of the wires 40, which also may act drag forces via the wires 40. During movement/orientation, the lengths of the wires 40 may be measured by the sensors 24 (FIG. 2). Also, the forces applied by the actuators 20*a-h* may be measured by the sensors 24 (FIG. 2) and/or estimated from input or output signals (e.g., current) associated with the actuators 20*a-h*.

Thus, the position of the equipment 14 may be determined from the sensor signals (direct kinematic). By comparing the determined position with the predetermined desired position (trajectory) of the equipment 14, the controller 32 can determine the forces for the actuators 20*a-h* and the desired wire length to enable a movement of the equipment 14 along the desired trajectory. It should be appreciated that each of the wire forces comprises a pretension (drag-force) part to enable a static equilibrium and an additional dynamic part to enable the movement along the desired trajectory. The sum of forces results in a movement along the desired trajectory.

Numerous methods and devices may be used to reset the actuators 20*a-h* from the positions shown in FIG. 1C to the positions shown in FIG. 1A. Illustrative and non-limiting devices and systems are discussed below.

Figure 3:
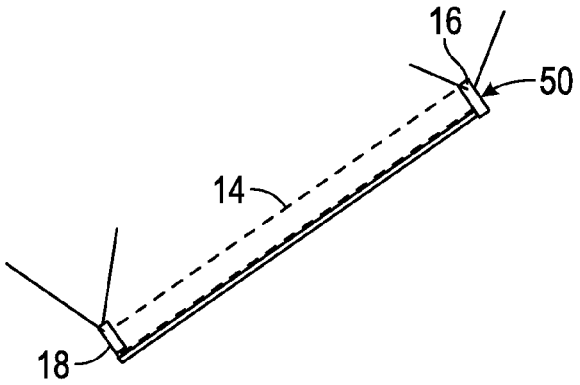
FIGS. 3 and 4 schematically illustrate devices that may be used to reposition one or more components of the FIGS. 1A-C system.
Figure 4:
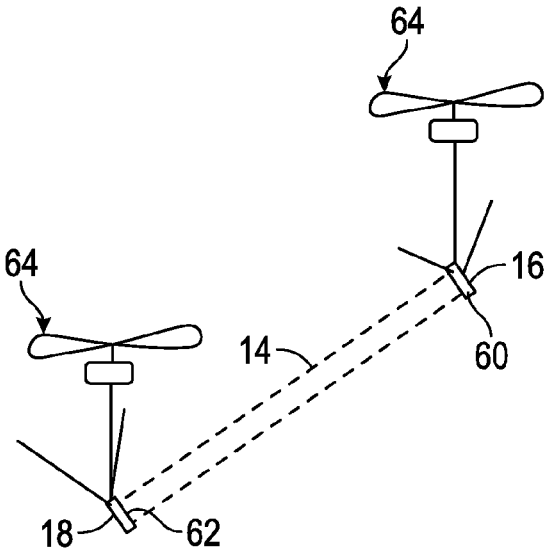

Referring now to FIG. 3, there is shown one embodiment of a frame 50 that may be used to reset the positions of the actuators 20*a-h* (FIG. 1A). The frame 50 may be skeletal member, brace, or rod on which the equipment 14 may be mounted. The upper attachment point 16 and the lower attachment point 18 may be formed on the frame 50. In the FIG. 1A position, the equipment 14 is attached to the frame 50. After the equipment has been detached from the frame 50 in the FIG. 1C position, the actuators 20*a-h* (FIG. 1A) may be used to move the frame 50 from the FIG. 1C position to the FIG. 1A position. Referring to FIG. 4, there is shown another arrangement for resetting the positions of the actuators. The FIG. 4 arrangement may include collars 60, 62 and self-propelled devices 64. The attachment points 16, 18 may be formed on the collars 60, 62 respectively. The self-propelled device 64 may be permanently connected to the collars 60, 62 or connected after the equipment 14 has been moved to the FIG. 1C position. To reset the actuators 20*a-h* (FIG. 1A), the self-propelled device 64 is operated to move the collars 60, 62 until the actuators 20*a-h* are in the FIG. 1A positions. The self-propelled devices 64 may be airborne crafts such as helicopters that may be guided along a desired flight path. The self-propelled devices 64 may move along separate wire lines, like a tram. The self-propelled devices 64 may be pre-programmed with instructions to move autonomously or be guided by human control.

Figure 5:
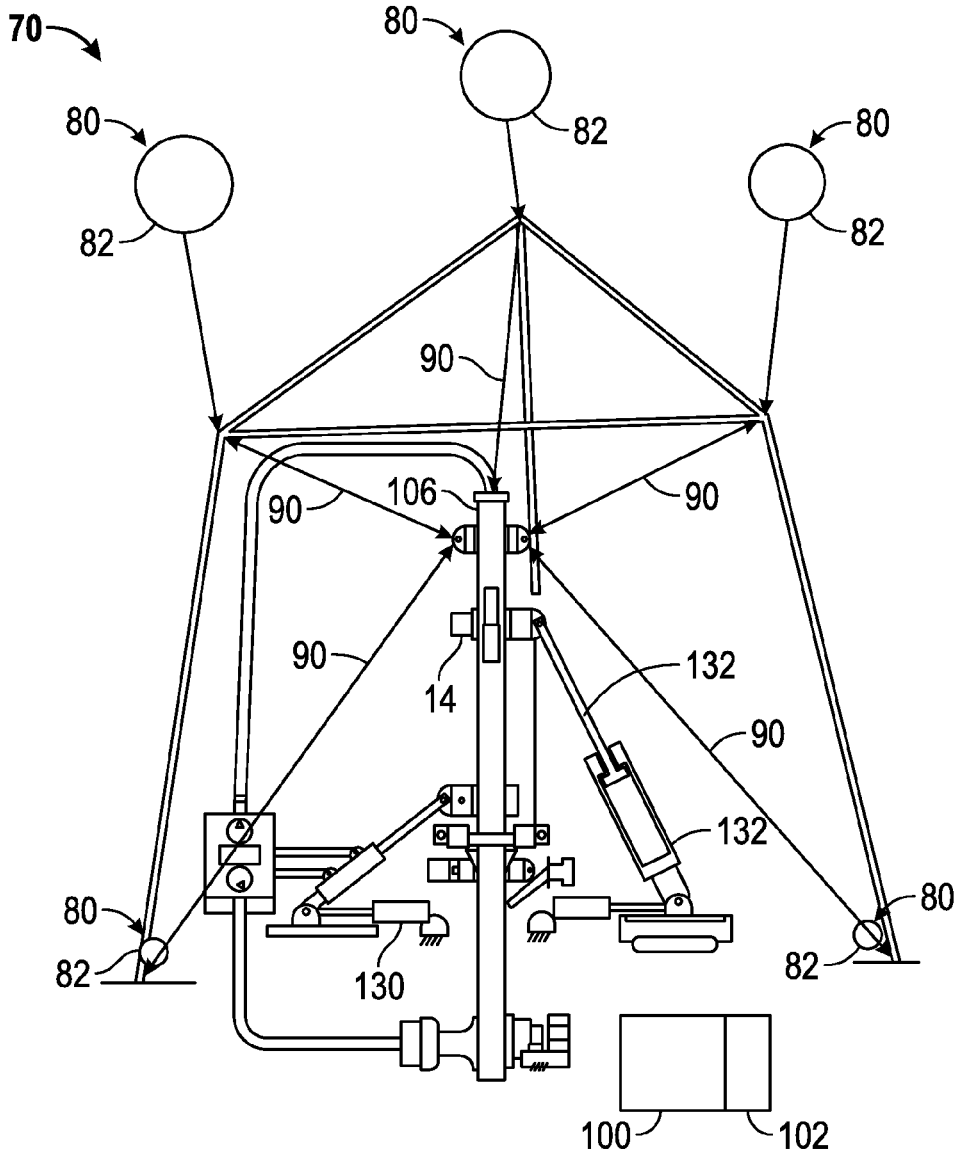
FIG. 5 schematically illustrates illustrate an underwater exemplary well equipment handling system that uses parallel kinematics in accordance with one embodiment of the present disclosure.

Referring to FIG. 5, there is shown an equipment handling system 70 in accordance with one embodiment of the present disclosure that is suitable for underwater use. The system 10 may include a plurality of actuators 80, a plurality of wires 90, and a controller 100. As discussed previously, the controller 100 may be programmed to control the length and/or tension of the wires 90 by transmitting appropriate control signals to the actuators 80. By manipulating the wires 90 in this manner, equipment 14 connected to the wires may be precisely moved and oriented.

Figure 6:
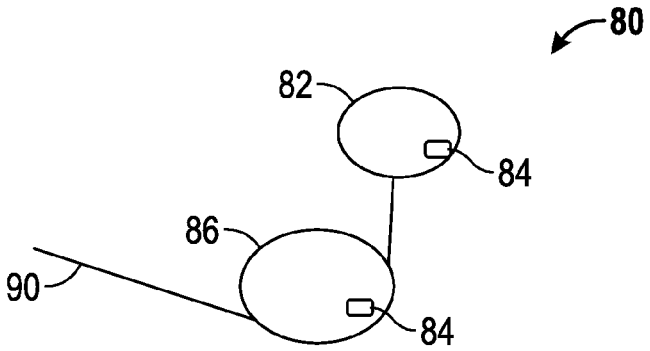
FIG. 6 schematically illustrates an actuator for use with the FIG. 5 system.

Referring to FIG. 6, in one embodiment, the actuators 80 may each include an adjustable ballast member 82 and one or more sensors 84. The adjustable ballast members 82 may be controlled using control signals transmitted via data carriers (not shown) by the controller 100 (FIG. 5). In one arrangement, the ballast/float members 82 may have adjustable buoyancy in water. For instance, a gas can be selectively introduced or released from an interior of the ballast/float member 82. More generally, any fluid (gas or liquid) may be used to vary the density of the ballast/float member 82 relative to the surrounding water. The amount of buoyancy controls the tension on the wires 90. Thus, increasing the buoyancy pulls the wire 90 toward the surface and shortens the distance between a pulley 86 and the attachment points 106 (FIG. 5) and reducing the buoyancy lengthens the wire 90 between the pulley 86 and the attachment points 106 (FIG. 5). While the ballast member 82 is shown as a spherical body, any shape may be used.

In another embodiment, the actuators 80 may each include the rotary power device 22 shown in FIG. 2. Also, the sensors 84 may be configured in the same manner as the sensors 24 shown in FIG. 2. For instance, the sensors 84 may estimate parameters such as displacement, length, distance, tension, current, voltage drops, RPM, etc. In still other embodiments, an actuator 80 may include both a rotary power device and a ballast member 82.

In the above described embodiments, a suitable bi-directional transmitter 102 may be used to transmit the sensor information to the controller 100 and to transmit control signals from the controller 100 to the actuators 80.

The actuators 80 may be distributed around the equipment in order to have at least six degrees of freedom of movement. In this arrangement, there are three attachment points 106. One or more actuators 80 may be attached to each one of the attachment points 106. The attachment points 106 may be anywhere along the axial length of the equipment 14. Likewise, while five actuators 80 are shown, greater or fewer number of actuators may be used.

Referring to FIG. 5, as described previously, it should be appreciated each of the actuators 80 apply a force vector (e.g., tension at a specific direction) to the equipment 14. It should also be appreciated that the length of wire 90 between each of the actuators 80 and their respective attachment points 106 determines the location and orientation of the equipment 14.

The controller 100 may be used to orient and move the equipment 14. In one arrangement, the controller 100 may be programmed to autonomously control the treatment operation. For instance, the controller 100 may include an information processing device (not shown) that may be programmed with algorithms, programs, mathematical models, or instructions to estimate an orientation and/or position relating to the equipment 14 based on the information acquired from the sensors 84 (FIG. 6). The controller 100 may also be programmed with a predetermined path or trajectory for the equipment. Based on this pre-programming and acquire information, the controller 100 may operate in an autonomous mode to move/orient the equipment 14. The controller 100 may also be responsive to human inputs and thereby operate in a manual or semi-autonomous mode. The controller 100 may include a communication device 104 for communicating with the actuators 80. The communication device 100 may use wired communication equipment or other communication regime for underwater applications.

It should be noted that in the FIG. 5 and FIG. 6 embodiment, the system 10 is used in conjunction with an equipment handling and/or drilling system 130 that uses parallel or hybrid (serial and parallel) kinematics. In a serial kinematic system, a tension or compression force is transmitted from one joint 132 to another joint 132, e.g., robotic arms. In a parallel kinematic system, tension and compression forces of multiple independent working joints/systems working together to self increase and optimize the strength of the structure with regard to a given task. The parallel controlled actuators, e.g. wire systems under tension or hydraulic piston systems under compression, are parts of the mechanical structure and therefore reducing the demand of support from a static frame which is normally not fully utilized in terms of strength capabilities in each degree of freedom. (e.g. bionic spider systems). The controller 100 may be programmed to coordinate movement of the equipment using the equipment handling and drilling system 130 to find the predefined positions and calculates the optimum amount of linear forces to be applied from the actuators to guarantee a strength to load balanced structure in parallel. The system can be called Automated Linear Feeding Regulation & Energy Distribution System (ALFREDS).

The term "information" as used above includes any form of information (Analog, digital, EM, printed, etc.). The term "information processing device" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. An apparatus for manipulating an object, comprising:

a first actuator having a least one non-rigid tension member configured to engage the object at a first contact point;

a second actuator having at least one non-rigid tension member configured to engage the object at a second contact point; and a controller in communication with the first actuator and the second actuator, the controller estimating a length of the at least one non-rigid tension member of the first actuator and the second actuator, the controller being programmed to control the first actuator and the second actuator to orient the object relative to an internal reference frame and move the object relative to an external reference frame.

2. The apparatus of claim 1, further comprising at least one sensor associated with each of the first actuator and the second actuator, the at least one sensor generating a signal representative of at least one parameter selected from a group consisting of:

(i) a length of at least one of the at least one non-rigid tension members, (ii) a tension along at least one of the at least one non-rigid tension members, (iii) a position of at least one of the at least one non-rigid tension members; and (iv) an orientation of at least one of the at least one non-rigid tension members.

3. The apparatus of claim 2, wherein the controller is programmed to move the object based on the at least one sensor signals.

4. The apparatus of claim 1, wherein the controller is programmed with a predetermined travel path for the object, and wherein the controller controls the first actuator and the second actuator to move the object along the predetermined travel path.

5. The apparatus of claim 1, wherein the first actuator applies a tension to the object in at least two discrete directions at the first contact point, and the second actuator applies a tension to the object in at least two discrete directions at the second contact point.

6. The apparatus of claim 1, further comprising:

a third actuator having a least one non-rigid tension member configured to engage the object at a third contact point; and a fourth actuator having at least one non-rigid tension member configured to engage the object at a fourth point, wherein the first and the third contact points are co-located and the second and the fourth contact points are co-located, wherein the first and the third actuators generate substantially opposing forces on the object, wherein the second and the fourth actuators generate substantially opposing forces on the object, and wherein the first, second, third, and fourth actuators cooperate to handle the object using at least six degrees of freedom.

7. The apparatus of claim 6, wherein the first, second, third, and fourth actuators each include: (i) at least two non-rigid tension members, (ii) a drum for guiding each tension member of the at least two tension members, and (iii) a motor rotating the drum.

8. The apparatus of claim 1, further comprising a subsea rig positioned at a subsea floor, and further comprising a buoyant member connected to at least one of: (i) the first actuator, and (ii) the second actuator.

9. The apparatus of claim 8, wherein the buoyant member operatively engages and applies a tension on at least one of the at least one non-rigid tension member associated with one of: (i) the first actuator, and (ii) the second actuator.

10. The apparatus of claim 8, wherein a buoyancy of the buoyant member is adjustable in situ.

11. The apparatus of claim 10, further comprising a rig disposed over a wellbore accessing the subsurface location, and wherein the first actuator and the second actuator are positioned on the rig.

12. An apparatus for manipulating well equipment, comprising:

a rig;

a plurality of actuators distributed on the rig, the actuators cooperating to orient and move the well equipment, wherein each actuator includes:

at least one non-rigid tension member configured to engage the well equipment, and at least one sensor generating a signal representative of at least one parameter selected from a group consisting of: (i) a length of at least one of the at least one non-rigid tension members, (ii) a tension along at least one of the at least one non-rigid tension members, (iii) a position of at least one of the at least one non-rigid tension members; and (iv) an orientation of at least one of the at least one non-rigid tension members, a drum guiding each of the at least one non-rigid tension members, and a motor rotating each drum; and a controller in communication with the actuators, wherein the controller is programmed to move the object based on the at least one sensor signals, wherein the actuators generate substantially opposing forces on the object and handle the object using six degrees of freedom of movement.

13. The apparatus of claim 12, wherein the controller is programmed with a predetermined travel path for the object, and wherein the controller controls the actuators to move the object along the predetermined travel path.

14. The apparatus of claim 12 further comprising an automated parallel or hybrid kinematic equipment handling and mechanical structure optimization system.

15. A method for manipulating an object, comprising:

positioning an object manipulating apparatus on a rig, the object manipulating apparatus including:

a first actuator having a least one non-rigid tension member configured to engage the object at a first contact point;

a second actuator having at least one non-rigid tension member configured to engage the object at a second contact point; and a controller in communication with the first actuator and the second actuator, the controller estimating a length of the at least one non-rigid tension member of the first actuator and the second actuator, the controller being programmed to control the first actuator and the second actuator to orient the object relative to an internal reference frame and move the object relative to an external reference frame; and orienting and moving the object by operating the object manipulating apparatus.

16. The method of claim 15, further comprising moving the object along a predetermined travel path.

17. The method of claim 15, wherein the object is at least one of:

a tubular, pipe, drill pipe, a packer, a bridge plug, a drill collar, a casing, a liner, a screen, a drilling motor, an MWD sub, a bottom hole assembly, a completion tool, a workover tool, and an electric submersible pump.

18. The method of claim 15, further comprising positioning the rig at a subsea floor, and further comprising connecting a buoyant member to at least one of the actuators.

* * * * *